US005925863A

United States Patent [19]

Zehnder et al.

[11] Patent Number: 5,925,863

[45] Date of Patent: Jul. 20, 1999

[54] POWER BREAKER

[75] Inventors: Lukas Zehnder, Baden-Dättwil; Kurt Kaltenegger, Lengnau; Lorenz Müller, Gebenstrof; Lutz Niemeyer, Birr, all of Switzerland

[73] Assignee: ABB Research Ltd., Zurich, Switzerland

[21] Appl. No.: 08/921,242

[22] Filed: Aug. 29, 1997

[30] Foreign Application Priority Data

Nov. 5, 1996 [DE] Germany ..... 196 45 524

[51] Int. Cl.[6] ..... H01H 33/78

[52] U.S. Cl. ..... 218/53; 218/72

[58] Field of Search ..... 218/43, 46, 48–54, 218/57–65, 68, 72–76

[56] References Cited

U.S. PATENT DOCUMENTS

| | | | |
|---|---|---|---|
| 4,328,403 | 5/1982 | Frink et al. | 200/148 A |
| 4,562,322 | 12/1985 | Yamaguchi et al. | 200/148 G |
| 4,791,256 | 12/1988 | Yonezawa et al. | 200/148 R |
| 5,274,205 | 12/1993 | Tsukushi et al. | 200/148 A |

FOREIGN PATENT DOCUMENTS

| | | | |
|---|---|---|---|
| 0177714B1 | 4/1986 | European Pat. Off. | H01H 33/98 |
| 2324125C2 | 11/1974 | Germany | H01H 33/74 |
| 2745965 | 7/1978 | Germany | H01B 3/30 |
| 3642509C2 | 6/1988 | Germany | H01H 33/74 |
| 4111932A1 | 10/1992 | Germany | H01H 33/74 |

OTHER PUBLICATIONS

"Ablation Controlled Arcs", Ruchti and Niemeyer, IEEE Transactions on Plasma Science, vol. PS–14, No. 4, Aug. 1986, pp. 423–434.

*Primary Examiner*—Michael A. Friedhofer
*Attorney, Agent, or Firm*—Burns, Doane, Swecker & Mathis, L.L.P.

[57] ABSTRACT

The power breaker is provided with a contact arrangement which is equipped with erosion-resistant contact members and has a stationary contact member (4), a contact member (4) which can move along a central axis (6) and an insulating nozzle (6) which concentrically surrounds the contact members (3, 4) and has a constriction (6). The insulating nozzle (6) is manufactured from an erosion-resistant plastic and is structured such that erosion channels which are formed run at right angles to the direction of the electrical field load. This insulating nozzle emits gases during disconnection, which particularly effectively support the production of blowing pressure in the arc zone.

18 Claims, 2 Drawing Sheets

POWER BREAKER

BACKGROUND OF THE INVENTION

1. Field of the Invention

The invention relates to an electrical power breaker having erosion-resistant contact members and a insulating nozzle.

2. Discussion of Background

Electrical power breakers are known which have a power current path with two contact members which can move relative to one another. During disconnection, an arc occurs in the switching path between the two contact members, part of which burns in an insulating nozzle. The thermal effects of the arc act on the surface of the insulating nozzle, and the nozzle constriction, which is critical to the flow conditions in the insulating nozzle, burns out, so that the cross section of the nozzle constriction is enlarged. If this increase in cross section exceeds certain limits, it has a negative influence on the disconnection capacity of the power breaker. In order to keep this undesirable increase in cross section comparatively small, erosion-resistant fluorocarbon polymers, for example polytetrafluoroethylene (PTFE), are used for the production of the insulating nozzle. These fluorocarbon polymers on the one hand have relatively low shape erosion, but on the other hand have comparatively high local depth erosion, which extends into the deeper regions under the surface of the insulating nozzle. Particularly as a result of the depth erosion, carbon is released which causes undesirable sooting of the insulating nozzle erosion channels, which are located under the surface. These sooted surfaces of the erosion channels which, in consequence, are electrically conductive, can, once the arc has been extinguished, lead to restrikes between the two power breaker contact members, which are then at a different potential, and this can lead to failure of the power breaker.

In order to avoid damaging sooting, an appropriate filler or a pigment can be added to the respective fluorocarbon polymer. Such additives largely prevent, in particular, depth erosion and thus the sooting but, as a rule, they result in a greater erosion rate and thus greater depth erosion as well, so that the life of the insulating nozzle is greatly reduced. This means that the insulating nozzle must be replaced comparatively frequently in the course of time-consuming maintenance of the power breaker.

SUMMARY OF THE INVENTION

Accordingly, one object of the invention, is to provide a novel electrical power breaker which has an insulating nozzle which emits gases during disconnection, which gases particularly effectively support the production of blowing pressure in the arc zone.

This power breaker has a contact arrangement which is equipped with erosion-resistant contact members and has a stationary contact member, a contact member which can move along a central axis, and a cylindrically designed insulating nozzle which concentrically surrounds the contact members and has a constriction. The insulating nozzle is manufactured from an erosion-resistant plastic.

PTFE, FEP, PFA, ETFE or similar aliphatic polymers or a mixture of at least two of these plastics can be provided as erosion-resistant plastic. Furthermore, PA, PI, PSU, PPS or a similar aromatic polymer or a mixture of at least two of these plastics can be used as erosion-resistant plastics.

The erosion-resistant insulating nozzle is in this case structured such that the electrically conductively sooted erosion channels under the surface of the insulating nozzle run at right angles to the direction of the electrical field load, so that they cannot cause any restriking in the power breaker.

The gases emerging from the insulating nozzle support the build up of pressure in the arc zone in this power breaker, enabling particularly effective blowing of the arc.

Further exemplary embodiments of the invention and the advantages which can be achieved by them are explained in more detail in the following text with reference to the drawings, which illustrates only one possible version.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only those elements which are required for direct understanding of the invention are illustrated.

DESCRIPTION OF THE PREFERRED EMBODIMENTS

Figure 1:
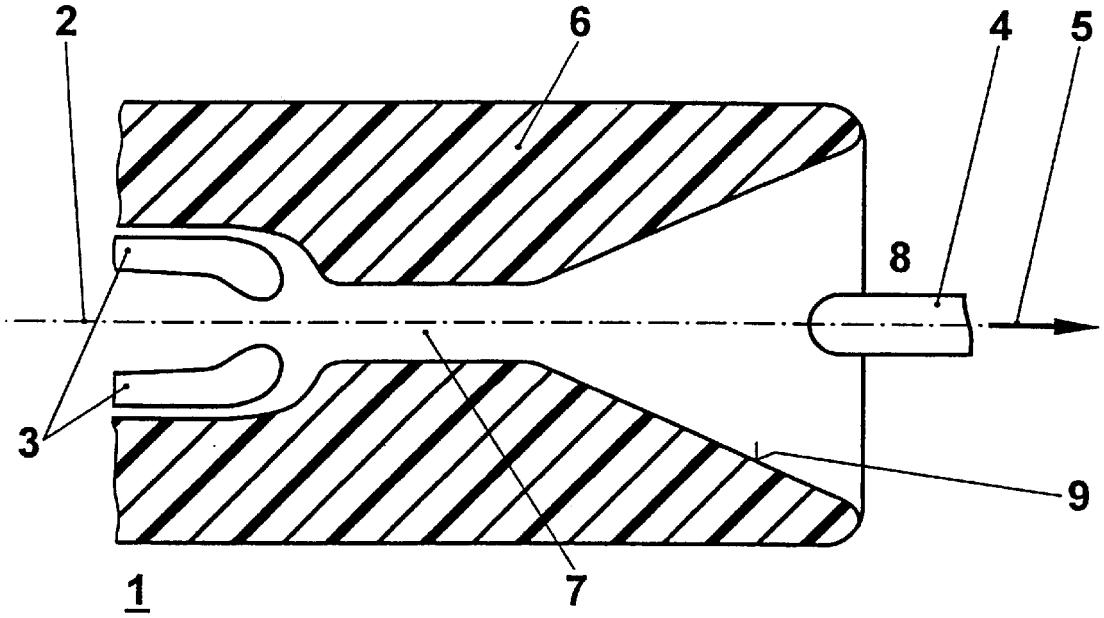
FIG. 1 shows a highly simplified partial section through a power breaker according to the invention.

Referring now to the drawings, wherein like reference numerals designate identical or corresponding parts throughout the several views, FIG. 1 shows a schematically illustrated partial section through the arcing chamber 1 of a power breaker, in which the arcing chamber housing is not illustrated, in the same way as the rated current path, which is normally present. The arcing chamber 1 is filled with an insulating gas, and as a rule this is $SF_6$ gas which is subjected to an increased pressure in the region of 5 to 6 bar. The arcing chamber 1 is of cylindrical design and extends along a central axis 2. The arcing chamber 1 has, for example, a stationary contact member 3 and a moving contact member 4, which can move relative to one another along the central axis 2. The sprung, stationary contact member 3 surrounds the moving contact member 4 when the arcing chamber 1 is in the connected state. The moving contact member 4, which is in this case designed as a cylindrical contact pin, moves in the direction of an arrow 5 when disconnection is taking place. An insulating nozzle 6 which is firmly connected to the stationary contact member 3 surrounds the two contact members 3 and 4 concentrically. When the arcing chamber 1 is in the connected state, the moving contact member 4 closes the constriction 7 in the insulating nozzle 6. Once the two contact members 3 and 4 have been disconnected, an arc is struck in the region of the constriction 7 and, as the disconnection movement of the moving contact member 4 progresses, also in the region of the conically formed opening in the cross section of the insulating nozzle 6, in the direction of the downstream exhaust area 8 of the arcing chamber 1. The surface 9 in the constriction 7 and in the conically expanding region of the insulating nozzle 6 is subjected to the thermal effect of the arc. The boundaries of the exhaust area 8 are not illustrated.

The material envisaged as the erosion-resistant plastic for the production of the insulating nozzle 6 is a material from the group of aliphatic polymers such as polytetrafluoroethylene (PTFE), fluoroethylenepropylene (FEP), perfluoroalkoxy (PFA), ethylenetetrafluoroethylene (ETFE) or a similar aliphatic polymer or a mixture of at least two of these plastics. Alternatively, a material can also be envisaged as the erosion-resistant plastic which is a material from the group of aromatic polymers such as polyamide (PA), polyimide (PI), polysulfone (PSU), polyphenylenesulfide (PPS) or a similar aromatic polymer or a mixture of at least two of these plastics. The thermal stress in these polymers during the disconnection of high-power arcs leads to the production of a comparatively large amount of gas, which can advantageously be used for blowing out the arc.

Figure 2:
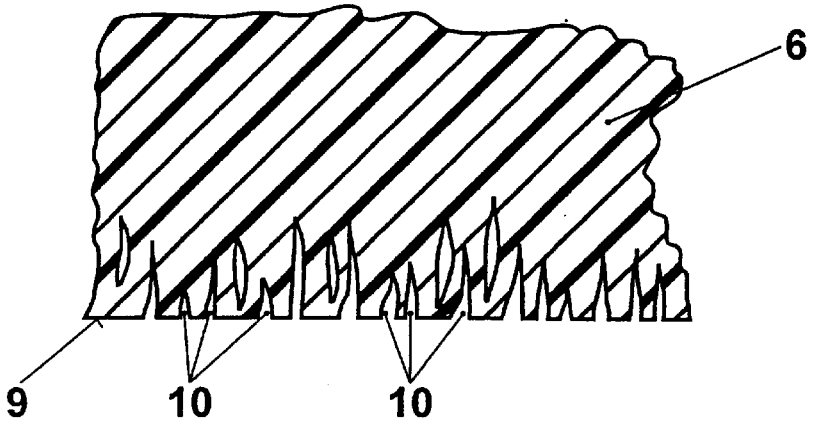
FIG. 2 shows a highly simplified partial section through an insulating nozzle made of a first insulating material.

FIG. 2 shows a highly simplified and greatly enlarged partial section through an insulating nozzle 6, which is in this case produced from pure polytetrafluoroethylene (PTFE). During the production of the nozzle blank, the erosion-resistant polytetrafluoroethylene (PTFE) was prestressed by axial dilation. When the thermal effects of the arc act on the surface 9 of the constriction 7, then comparatively flat erosion channels 10 are formed in this material, starting from the surface 9. In this exemplary embodiment, the surface 9 runs concentrically about the central axis 2. The plane of the erosion channels 10 is in this case located at right angles to the central axis 2, because of the said prestressing, and thus parallel to the electrical equipotential surfaces which are formed after disconnection between the two contact members 3 and 4. Switching residues which may be deposited in the erosion channels 10, or the soot particles produced in them, cannot form conductive tracks because of the transverse extent of these tracks, which tracks could initiate dielectrically caused flashovers between the two contact members 3 and 4 after the arc is extinguished.

Figure 3:
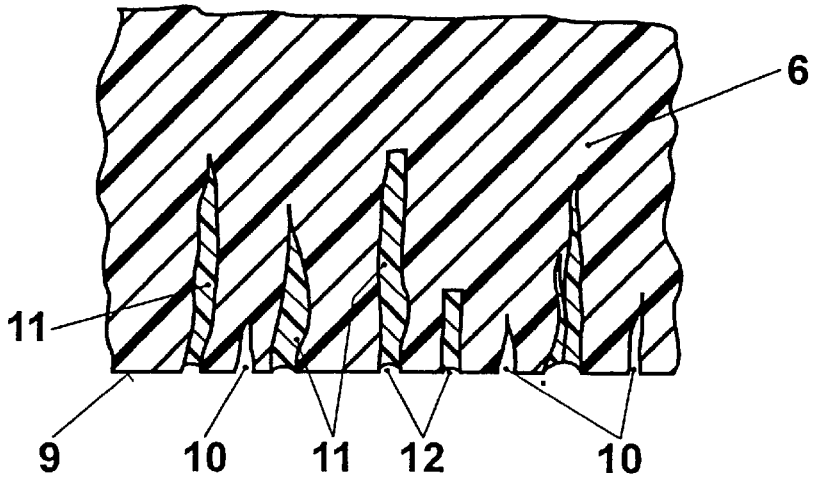
FIG. 3 shows a highly simplified partial section through an insulating nozzle made of a second insulating material.

FIG. 3 shows a highly simplified partial section through an insulating nozzle 6, which is in this case produced from a polymer mixture. Polytetrafluoroethylene (PTFE) was used as the basis of this mixture. Another polymer containing hydrogen was incorporated into the polytetrafluoroethylene (PTFE) in the form of flat, elongated particles 11, which are either in the form of flakes, such as POM, or in the form of fibers, such as PA fiber materials. During production of the nozzle blank, care was taken to arrange the particles 11 at right angles to the central axis 2. The surface 9 of the constriction 7 also runs concentrically around the central axis 2 in this exemplary embodiment. The other polymer containing hydrogen erodes somewhat faster than the polytetrafluoroethylene (PTFE), as indicated by the recesses 12, which are indicated in FIG. 3, in the surface 9 of the constriction 7. This mixture of polymers results in gas being developed particularly intensively in the insulating nozzle 6. Wherever no particles 11 reach the surface 9 in this embodiment variant, it is possible for the erosion channels 10 to be formed, which have already been described in conjunction with FIG. 2. This insulating nozzle variant is advantageously used wherever support to the production of the blowing pressure is particularly desirable.

The amount of gas developed in the insulating nozzle 6 can be further considerably improved in this design variant if the particles 11 are additionally pigmented with a pigment such as $MOS_2$, which advantageously increases their erosion rate and thus also the amount of gas produced and available for blowing out the arc.

Figure 4:
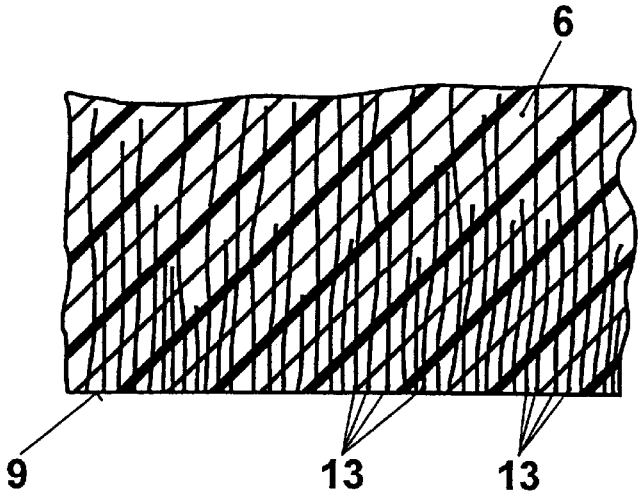
FIG. 4 shows a highly simplified partial section through an insulating nozzle made of a third insulating material.

FIG. 4 shows a highly simplified partial section through an insulating nozzle 6, which is in this case produced from polytetrafluoroethylene (PTFE) in which quartz fibers 13 have been introduced, at right angles to the central axis 2. This insulating nozzle 6 preferably burns along the quartz fibers 13 when acted on thermally by the arc. The gases produced during this burning away advantageously increase the blowing pressure in the arcing chamber 1. In addition, the sooting on the erosion channels is advantageously reduced, because of the oxidizing effect of the quartz fibers 13.

Figure 5:
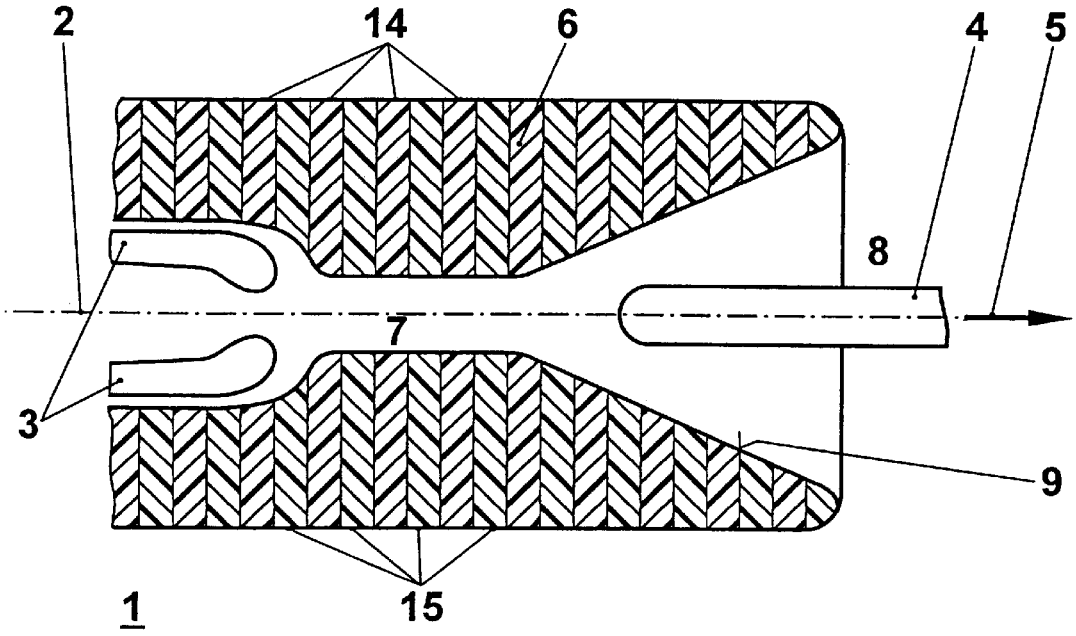
FIG. 5 shows a highly simplified partial section through a power breaker having an insulating nozzle made of a fourth insulating material.

FIG. 5 shows a further schematically illustrated partial section through the arcing chamber 1 of a power breaker. In this exemplary embodiment, the insulating nozzle 6 is formed from disks 14 and 15 that have been sintered together. The disks 14 and 15 are arranged at right angles to the central axis 2. The first disk 14 is in each case produced from pure polytetrafluoroethylene (PTFE). The second disk 15 is in each case produced from polytetrafluoroethylene (PTFE) to which 5% by weight of $MOS_2$ has been added, this being used as structured pigmentation. In order to produce the nozzle blank, these disks 14 and 15 are laid alternatively on one another and are sintered together in a known manner to form a monolithic block. In the case of this embodiment, the second disk 15 burns away to a greater extent. The gases produced during this burning advantageously increase the blowing pressure in the arcing chamber 1. The amount of pressurized gas produced in this way is considerably greater than would be the case if pure polytetrafluoroethylene (PTFE) were used. A disk thickness of 1 mm has been found to be useful for disconnecting currents in the region around 50 $kA_{rms}$. If it is intended to produce a greater amount of gas, then the second disk 15 is constructed to be somewhat thicker than the first disk 14. It is also feasible for disks 14 and 15 of different thickness to be provided distributed over the length of the insulating nozzle 6 since, in this way, the amount of gas produced for blowing out the arc can be optimally matched to the respective operating conditions.

It is also normally possible to add to the disks 14 and 15 different quantities of oxidizing fillers. This addition is then optimized such that only a negligible amount of soot formation occurs in the erosion channels that are formed. The amount of gas produced for blowing out the arc is in this case at the same time matched to the operating conditions to be expected.

Obviously, numerous modifications and variations of the present invention are possible in the light of the above teachings. It is therefore to be understood that within the scope of the appended claims, the invention may be practiced otherwise than as specifically described herein.

What is claimed is:

1. A power breaker having a contact arrangement which is equipped with erosion-resistant contact members and has a stationary contact member, a contact member which can move along a central axis, and an insulating nozzle which concentrically surrounds the contact members, has a constriction and is manufactured from an erosion-resistant plastic, wherein the insulating nozzle is structured such that erosion channels which are formed run at right angles to a direction of an electrical field load, and an aliphatic polymer or an aromatic polymer is provided as the erosion-resistant plastic, polytetrafluoroethylene (PTFE), fluoroethylenepropylene (FEP), perfluoroalkoxy (PFA), ethylenetetrafluoroethylene (ETFE) or a similar polymer or a mixture of at least two of these polymers is provided as the aliphatic polymer, the polytetrafluoroetheylene (PTFE) being prestressed by axial dilatation.

2. A power breaker having a contact arrangement which is equipped with erosion-resistant contact members and has a stationary contact member, a contact member which can move along a central axis, and an insulating nozzle which concentrically surrounds the contact members, has a constriction and is manufactured from an erosion-resistant plastic, wherein the insulating nozzle is structured such that erosion channels which are formed run at right angles to a direction of an electrical field load, and an aliphatic polymer or an aromatic polymer is provided as the erosion-resistant plastic, polytetrafluoroethylene (PTFE), fluoroethylenepropylene (FEP), perfluoroalkoxy (PFA), ethylenetetrafluoroethylene (ETFE) or a similar polymer or a mixture of at least two of these polymers is provided as the aliphatic polymer, a polymer containing hydrogen being added to the polytetrafluoroethylene (PTFE), the polymer comprising elongated particles aligned at right angles to the central axis, and polyoxymethylene (POM) flakes or polyamide (PA) fibers being provided as the particles.

3. The power breaker as claimed in claim 2, wherein the particles are pigmented with a pigment.

4. The power breaker as claimed in claim 3, wherein the pigment is $MoS_2$.

5. A power breaker having a contact arrangement which is equipped with erosion-resistant contact members and has a stationary contact member, a contact member which can move along a central axis, and an insulating nozzle which concentrically surrounds the contact members, has a constriction and is manufactured from an erosion-resistant plastic, wherein the insulating nozzle is structured such that erosion channels which are formed run at right angles to a direction of an electrical field load, and an aliphatic polymer or an aromatic polymer is provided as the erosion-resistant plastic, polytetrafluoroethylene (PTFE), fluoroethylenepropylene (FEP), perfluoroalkoxy (PFA), ethylenetetrafluoroethylene (ETFE) or a similar polymer or a mixture of at least two of these polymers is provided as the aliphatic polymer, glass fibers aligned at right angles to the central axis being incorporated in the polytetrafluoroethylene (PTFE).

6. A power breaker having a contact arrangement which is equipped with erosion-resistant contact members and has a stationary contact member, a contact member which can move along a central axis, and an insulating nozzle which concentrically surrounds the contact members, has a constriction and is manufactured from an erosion-resistant plastic, wherein the insulating nozzle is structured such that erosion channels which are formed run at right angles to a direction of an electrical field load, and an aliphatic polymer or an aromatic polymer is provided as the erosion-resistant plastic, the insulating nozzle being composed of disks which are arranged at right angles to the central axis and are made of different polymers or of identical polymers that are doped differently.

7. The power breaker as claimed in claim 6, wherein the disks include a first disk of pure polytetrafluoroethylene (PTFE), and a second disk of polytetrafluoroethylene (PTFE) with a structured pigmentation.

8. The power breaker as claimed in claim 7, wherein the second disk has five percent by weight of $MoS_2$ added as pigment.

9. The power breaker as claimed in claim 7, wherein the first and the second disks are designed to have equal or different thicknesses.

10. The power breaker as claimed in claim 9, wherein the first and the second disks have a thickness of about 1 mm.

11. The power breaker as claimed in claim 7, wherein thickness ranges of the first and of the second disks are different in the axial direction.

12. The power breaker as claimed in claim 6, wherein polytetrafluoroethylene (PTFE), fluoroethylenepropylene (FEP), perfluoroalkoxy (PFA), ethylenetetrafluoroethylene (ETFE) or a similar polymer or a mixture of at least two of these polymers is provided as the aliphatic polymer.

13. The power breaker as claimed in claim 12, wherein polytetrafluoroethylene (PTFE) prestressed by axial dilation is provided as the aliphatic polymer.

14. The power breaker as claimed in claim 13, wherein a polymer containing hydrogen is added to the polytetrafluoroethylene (PTFE), the polymer comprising elongated particles aligned at right angles to the central axis and polyoxymethylene (POM) flakes or polyamide (PA) fibers comprising the particles.

15. The power breaker as claimed in claim 14, wherein the particles are pigmented with a pigment.

16. The power breaker as claimed in claim 15, wherein the pigment is $MoS_2$.

17. The power breaker as claimed in claim 12, wherein glass fibers aligned at right angles to the central axis are incorporated in the polytetrafluoroethylene (PTFE).

18. The power breaker as claimed in claim 6, wherein polyamide (PA), polyimide (PI), polysulfone (PSU), polyphenlenesulfide (PPS) or a mixture of at least two of these polymers is provided as the aromatic polymer.

* * * * *